US006558136B1

(12) United States Patent
Peng

(10) Patent No.: US 6,558,136 B1
(45) Date of Patent: May 6, 2003

(54) MICROPUMP UNDERPRESSURE CONTROL DEVICE

(75) Inventor: Yu-Yin Peng, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 12 days.

(21) Appl. No.: 10/017,844

(22) Filed: Nov. 29, 2001

(51) Int. Cl.[7] ..... F04B 49/00

(52) U.S. Cl. ..... 417/298; 417/53; 417/413.1; 347/133

(58) Field of Search ..... 417/298, 207, 417/208, 209, 413.1, 413.2, 413.3, 48, 52, 53; 347/128, 133, 7, 54, 55, 61, 62

(56) References Cited

U.S. PATENT DOCUMENTS 5,759,014 A * 6/1998 Van Lintel ..... 417/413.3
5,880,748 A * 3/1999 Childers et al. ..... 347/6
6,062,681 A * 5/2000 Field et al. ..... 347/65
6,428,152 B1 * 8/2002 Hollands ..... 347/85

* cited by examiner

*Primary Examiner*—Charles G. Freay
*Assistant Examiner*—Han Lieh Liu
(74) *Attorney, Agent, or Firm*—Pro-Techtor International Services

(57) ABSTRACT

A micropump underpressure control device, working in conjunction with a micropump having an inlet and an outlet. The micropump underpressure control device comprises a control valve and a transmission tube. The control valve is installed at a supply pipe leading to the micropump and further comprises a case with a membrane, a valve assembly, a connecting rod and a spring. The membrane is exposed to pressure from the outlet of the micropump and accordingly deformed, via the connecting rod controlling opening and closing of the valve assembly, so that working liquid is allowed to proceed to the inlet of the micropump or blocked. The transmission tube transmits pressure at the outlet of the micropump to the membrane. On an opposite side, the membrane is pressed on by working liquid and by the spring. Thus pressure at the inlet of the micropump is controlled, being kept smaller than or equal to pressure at the outlet of the micropump by a fixed difference.

7 Claims, 4 Drawing Sheets

MICROPUMP UNDERPRESSURE CONTROL DEVICE

BACKGROUND OF THE INVENTION

1. Field of the Invention

The present invention relates to a micropump underpressure control device, particularly to a micropump underpressure control device maintaining a pressure difference between an inlet and an outlet of a micropump for better precision of the micropump and for preventing leaking out when the micropump is not in use.

2. Description of Related Art

Due to great progress of micromechanical and microelectronic production processes in recent years, along with research on a large scale, micropumps have been commercialized in inkjet printers, constituting the richest and greatest product and technique for research in fuel injection systems.

The main area of application of micropumps are printer heads. There are two types, heat bubble and piezoelectric micropumps. A heat bubble micropump has a flow path and an electric circuit on a silicon substrate and a plurality of ejection chambers. A surface thereof carries a nozzle plate. In a standby state, working liquid is held back in the ejection chambers due to capillarity. For operating the micropump, heat is generated by an electric current in the electric circuit, causing working liquid in ejection chambers to evaporate, forming bubbles which drive out liquid through ejection holes. A piezoelectric micropump has a substrate on which a membrane is laid, with chambers left in between. Piezoelectric material is laid on the membrane. Applying a varying electric voltage to the piezoelectric material displaces the membrane. Thus working liquid in the chambers is compressed and driven out through ejection holes in the substrate.

Currently, micropumps are mainly used in inkjet printers where precise dosing of ink is demanded. Therefore, precise control of the speed and quantity of dispensed ink is important.

Since a micropump furthers a tiny quantity of working liquid, pressure changes in the environment affect the precision thereof. A conventional micropump is usually installed in a casing, forming a closed device. Usage of spongy material results in underpressure against the exterior due to capillarity, preventing leaking of working liquid. After changing the environment, however, speed and quantity of dispensed ink are affected.

For precise operation of a micropump, it is required to maintain a fixed pressure difference between the inlet and the outlet thereof, so that speed and quantity of dispensed ink are stable and reproducible. A conventional micropump, however, does neither allow to control working pressure at the inlet nor external pressure at the outlet. Furthermore, after slowly releasing working liquid through the outlet, pressure in the casing (on the inlet side of the micropump) drops, increasing the difference to external pressure. Thus, with changing pressure difference between the inlet and the outlet, it is not possible to control speed and quantity of dispensed ink precisely.

SUMMARY OF THE INVENTION

It is the main object of the present invention to provide a micropump underpressure control device which is open to the exterior and automatically replenishes working liquid, while precisely controlling pressure difference between an inlet and an outlet, with inlet pressure being slightly lower than outlet pressure, resulting in continuing better precision of speed and quantity of dispensed ink, while during standby no working liquid leaks out.

For this, a control valve is mounted at an inlet tube of the micropump, being connected to a transmission tube. The transmission tube transmits pressure at an outlet to the control valve. The control valve has a membrane and a valve, the membrane following the pressure at the outlet, controlling the valve. Thus pressure of the working liquid at the inlet of the micropump is controlled.

By keeping pressure of the working liquid at the inlet of the micropump slightly below pressure at the outlet, the object of better precision of speed and quantity of dispensed ink is attained.

The present invention can be more fully understood by reference to the following description and accompanying drawings.

DETAILED DESCRIPTION OF THE PREFERRED EMBODIMENTS

Figure 1:
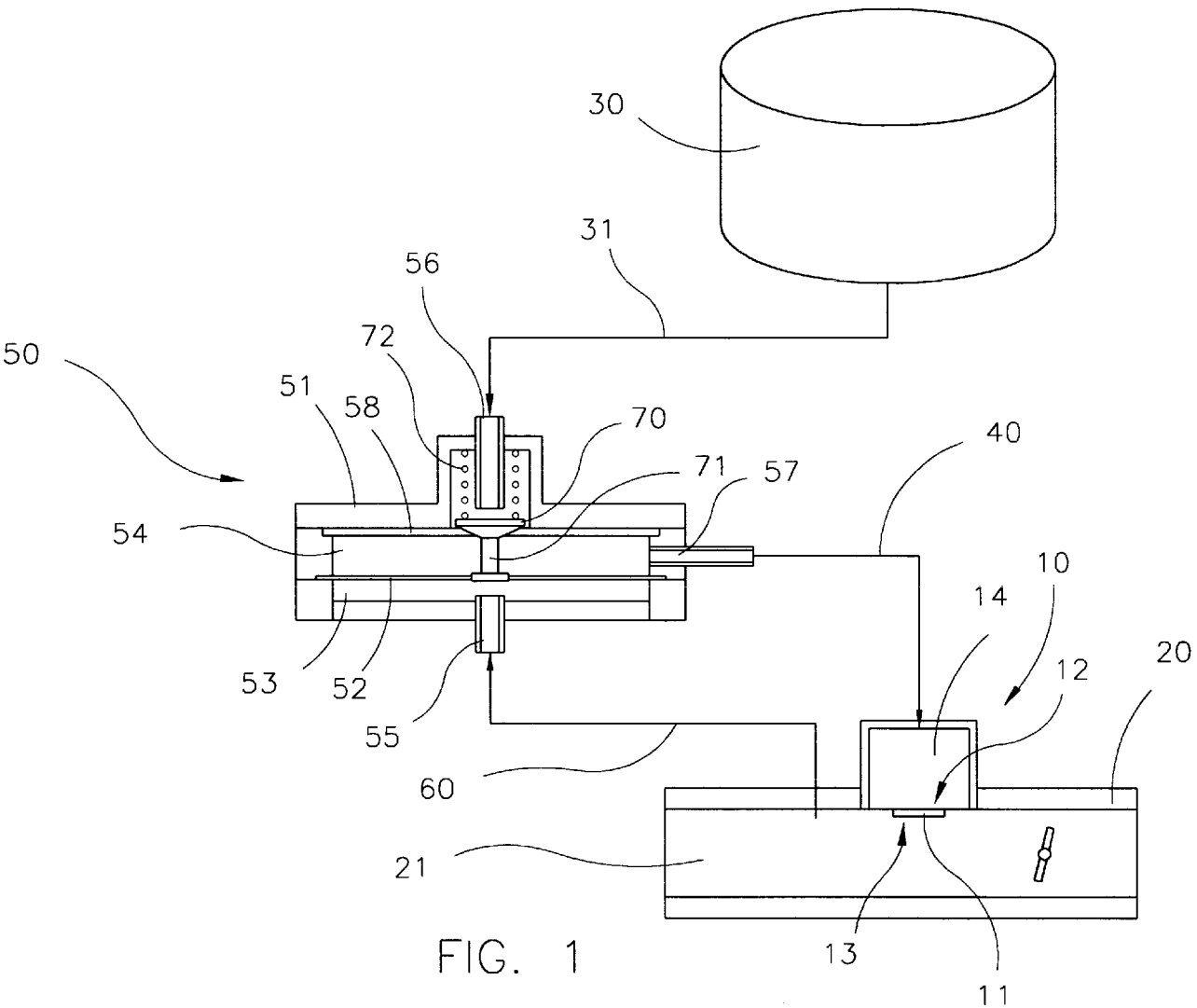
FIG. 1 is a schematic illustration of the micropump underpressure control device of the present invention in conjunction with a micropump in the first embodiment.

As shown in FIG. 1, the micropump underpressure control device of the present invention in a first embodiment mainly comprises: at least one ejection unit 10; a main body 20; a working liquid supply system 30; a supply pipe 40; a control valve 50; and a transmission tube 60. The ejection unit 10 is mounted on one side of the main body 20, having a central passageway 21. A micropump 11 ejects working liquid in tiny droplets into the passageway 21. The working liquid supply system 30 delivers working liquid through the supply pipe 40 to the ejection unit 10 to be sucked in by the micropump 11 and dispensed into the passageway 21. The control valve 50 is mounted on the supply pipe 40, controlling an inlet pressure of the working liquid when entering the micropump 11. The transmission tube 60 leads from the passageway 21 in the main body 20 to the control valve 50, allowing the control valve 50 to sense an outlet pressure of the working liquid, and to regulate the inlet pressure accordingly.

Figure 2:
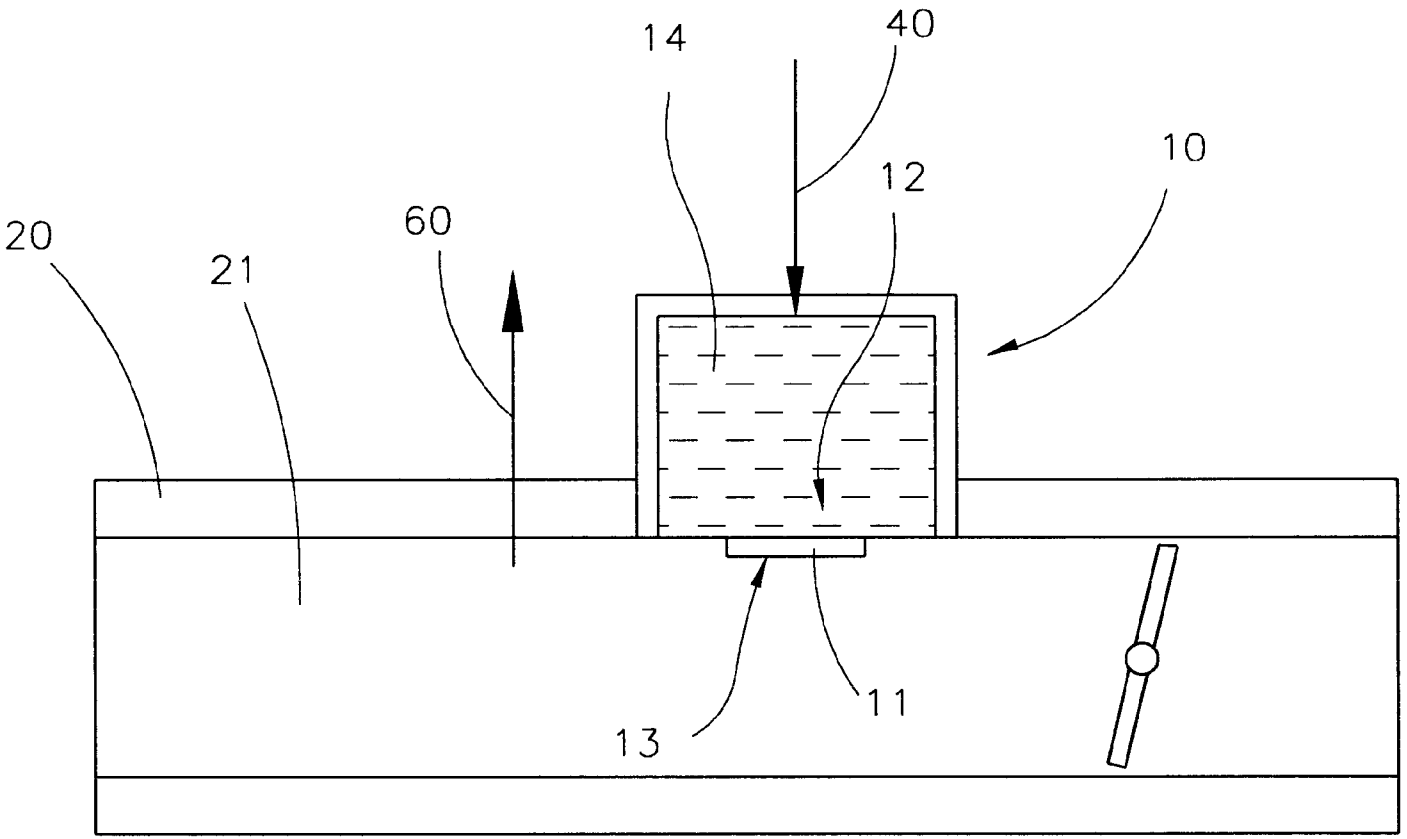
FIG. 2 is an enlarged sectional view of an ejection unit with a micropump used in conjunction with the present invention.

Referring to FIG. 2, the ejection unit 10 has at least one micropump 11, sucking in working liquid and ejecting tiny particles thereof, as controlled by an electric circuit system located inside. The micropump 11 has an inlet 12, through which working liquid enters the micropump 11, and an outlet 13, from where working liquid is ejected. The outlet 13 leads into the passageway 21, so that working liquid is ejected into the passageway 21 by the micropump 11. An inlet chamber 14 is placed on the inlet 12, being connected with a secondary end of the supply pipe 40. Thus working liquid enters the inlet chamber 14 before proceeding to the inlet 12 of the micropump 11.

Referring again to FIG. 1, when the micropump 11 of the ejection unit 10 is operating, speed and quantity of furthered working liquid depends on the inlet pressure thereof. The outlet pressure generated by the outlet 13 of the micropump 11 works against pressure in the passageway 21. A fixed difference between the inlet pressure and the outlet pressure is required, with the inlet pressure being less than or equal to the outlet pressure, so as to dispense working liquid with precise speed and in a precise quantity. For this purpose, the transmission tube 60 transmits the pressure in the passageway 21 into the control valve 50, causing the control valve 50 to set the inlet pressure at the inlet 12 of the micropump 11 accordingly. Thus a fixed difference between the inlet pressure and the outlet pressure is achieved.

In the first embodiment shown in FIG. 1, the main body 20 with the passageway 21 are connected with an underpressure source. Thus during operation underpressure is maintained in the passageway 21. Working liquid ejected into the passageway 21 is sucked into a connected device. In the first embodiment shown in FIG. 1, the outlet 13 is passed through by working liquid before entering a region with underpressure. Consequently, a fixed difference between the underpressure at the outlet 13 and the pressure at the inlet 12 has to be maintained, with the inlet pressure being less than or equal to the outlet pressure.

Figure 3:
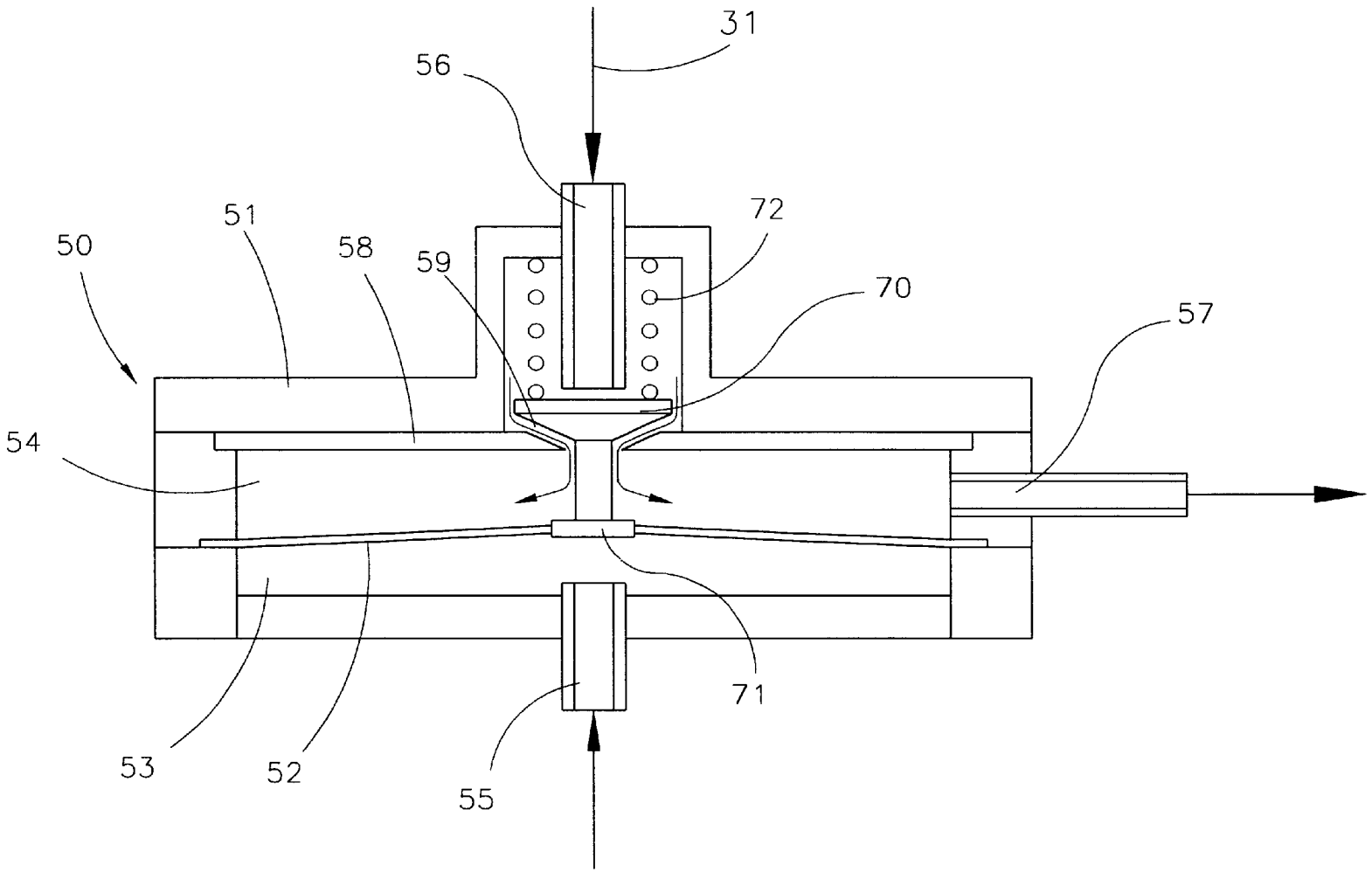
FIG. 3 is a sectional side view of the control valve of the present invention.

As shown in FIG. 3, the control valve 50 has a case 51 with an interior in which a membrane 52 is placed, dividing the interior of the case 51 into an upper part and a lower part. In the embodiment shown in FIG. 3, the lower part forms a pressure chamber 53, while the upper part forms a working liquid chamber 54. A valve inlet 55 leads into the pressure chamber 53 and is connected with the transmission tube 60. Thus the pressure chamber 53 is connected with the passageway 21, so that pressure in the pressure chamber 53 follows the outlet pressure at the outlet 13. Furthermore, a valve outlet 56 leads into the working liquid chamber 54. Working liquid, coming from the working liquid supply system 30 through a primary supply pipe 31, enters the working liquid chamber 54. A lateral outlet opening 57 allows working liquid to leave the working liquid chamber 54 and to proceed to the inlet chamber 14 through the supply pipe 40. Thus working liquid is delivered from the working liquid chamber 54 to the inlet chamber 14. A valve cone 70 is mounted between the valve outlet 56 and the working liquid chamber 54, controlling opening and closing movements of a valve passage 59. The valve cone 70 is shaped like a cone with a comparatively narrow lower end, being able to form a sealed connection with a valve seat 58 at an entrance of the working liquid chamber 54, preventing working liquid coming from the valve outlet 56 from entering the working liquid chamber 54. A connecting element 71 at an upper end thereof is attached to the lower end of the valve cone 70, in turn having a lower end that is connected with the membrane 52. When the membrane 52 deforms due to pressure change in the pressure chamber 53, the connecting element 71 follows in a corresponding movement. A spring 72 is placed above an upper end of the valve cone 70, countering the force of the membrane 52 on the valve cone 70.

Referring again to FIG. 3, the control valve 50 works by the membrane 52 being exposed to the outlet pressure at the outlet 13 while from above undergoing pressure by the working liquid. In an original state, due to pressure exercised by the spring 72 which seals the valve cone 72, no working liquid is able to flow into the working liquid chamber 54 and on to the inlet 12. Thus the inlet pressure is smaller than or equal to the outlet pressure, and no leaking of working liquid will occur. When working liquid is ejected by the micropump 11, the inlet pressure drops below the outlet pressure, since no working liquid is replenished through the inlet 12. Pressure in the working liquid chamber 54 is equal to the inlet pressure, therefore the membrane 52 is sucked into the working liquid chamber 54. Having a by far larger area than the valve cone 70, the membrane 52 overcomes the counter force of the spring 72, opening the valve cone 70, allowing working liquid to flow through the valve passage 59 to build up the inlet pressure. When pressure in the working liquid chamber 54 has risen to a value close to the outlet pressure, with the balance of the force sucking the membrane 52 upward and the force pulling the valve cone 70 downward no longer exceeding the force exercised by the spring 72, the valve cone 70 is closed and flow of working liquid stops. In this way, the negative pressure difference between the inlet pressure and the outlet pressure is maintained by repeated movements. While the outlet pressure is larger than the inlet pressure, the membrane 52 is pressed on by working liquid in the working liquid chamber 54, resulting in the inlet pressure staying smaller than or equal to the outlet pressure. When the outlet pressure largely exceeds the inlet pressure, overcoming the force of the spring 72, the membrane 52 is pushed upward, lifting the valve cone 70 and opening the valve passage 59 for working liquid to flow into the working liquid chamber 54 and on through the opening 57 into the inlet 12 of the micropump. After the valve passage 59 has opened and working liquid has flown into the working liquid chamber 54, pressure therein rises. As soon as the total force on the membrane 52 is directed downward, with combined pressure by working liquid in the working liquid chamber 54 and by the spring 72 exceeding the outlet pressure, the membrane 52 is pushed downward, via the connecting element 71 pulling the valve cone 70 tightly down on the valve seat 58, closing the valve passage 59, so that no further working liquid flows into the working liquid chamber 54 and the inlet pressure stays smaller than or equal to the outlet pressure. On the other hand, when the outlet pressure drops, pressure in the pressure chamber 53 subsequently drops, pulling the membrane 52 downward, so that the working liquid chamber 54 has an increased volume and consequently decreased pressure. Thus the inlet pressure stays smaller than or equal to the outlet pressure, maintaining a proper state of the micropump 11.

For using the control valve 50, the spring 72 is adjusted to exert suitable force. By competing forces on the membrane 52 due to pressures in the working liquid chamber 54 and the pressure chamber 53, it is achieved that the inlet pressure at the inlet 12 stays smaller than or equal to the outlet pressure at the outlet 13 and a balance is maintained. When the outlet pressure changes, the membrane 52 deforms, driving the valve cone 70, so that the inlet pressure is adjusted to a value below the outlet pressure by the preset difference. Besides replenishing working liquid by the micropump 11 in an open system, the inlet pressure is kept smaller than or equal to the outlet pressure. Therefore, during operation of the micropump 11 speed and quantity of dispensed working liquid are not affected by changes of the outlet pressure, and the object of precise operation is attained, with the micropump 11 working regularly in an environment of relatively large pressure variations.

Figure 4:
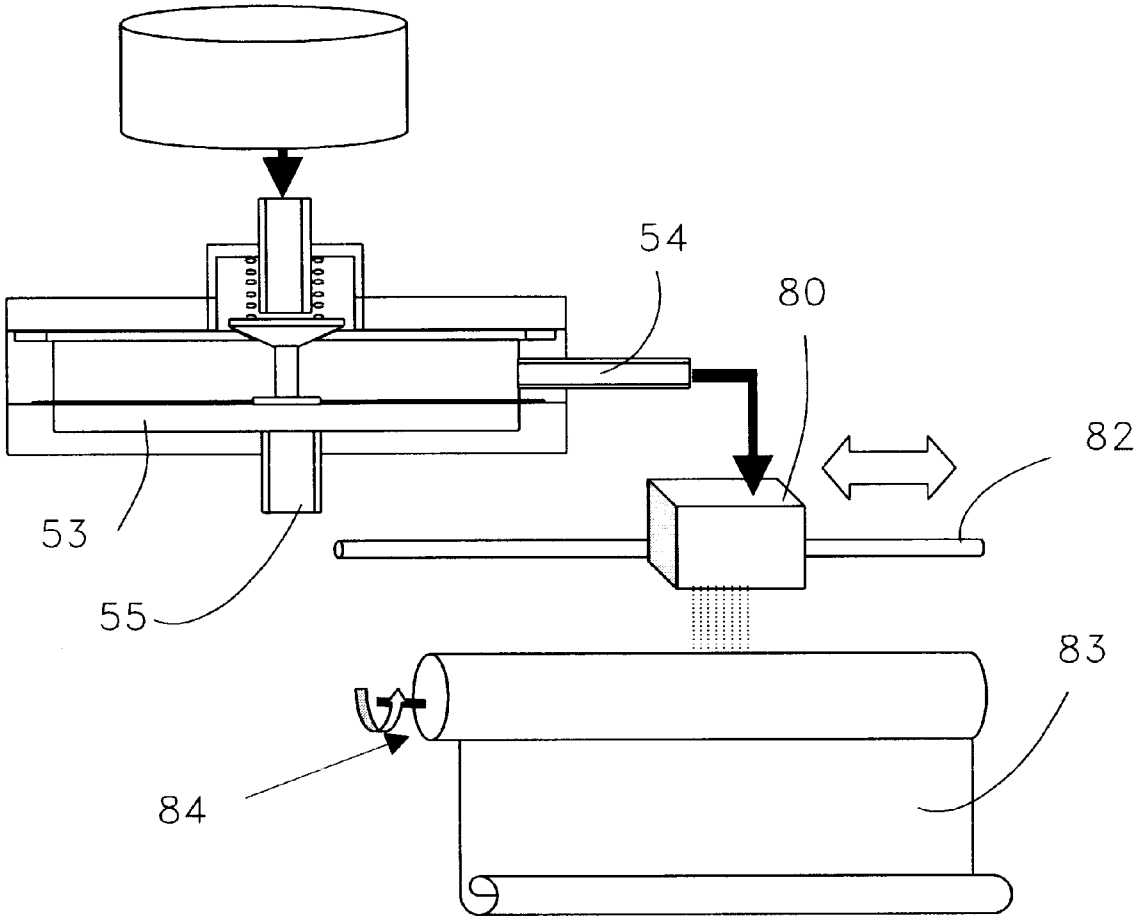
FIG. 4 is a schematic illustration of the micropump underpressure control device of the present invention in the second embodiment.

Referring to FIG. 4, the present invention in a second embodiment is used in conjunction with a plotter or continuous-paper printer where ink is replenished by underpressure for a maximum clear effect. Therein, ink is supplied from the working liquid chamber 54 to an ejection head 80.

The ejection head 80 is movable on a rail 82 along a roll 83 on which paper 83 is wound. The micropump 11 is installed in the ejection head 80. The pressure chamber 53 is via the valve inlet 55 exposed to exterior pressure, so that pressure in the working liquid chamber 54 is accordingly adjusted and inlet and outlet pressures at the micropump 11 maintain a fixed negative difference. Thus high quality of printing is achieved.

While the invention has been described with reference to preferred embodiments thereof, it is to be understood that modifications or variations may be easily made without departing from the spirit of this invention which is defined by the appended claims.

What is claimed is:

1. A micropump underpressure control device, working in conjunction with a micropump having an inlet drawing in working liquid and an outlet ejecting working liquid, said micropump underpressure control device comprising:

a control valve, installed at a supply pipe supplying working liquid to said micropump and further comprising a case, having an interior that is divided by a membrane into a working liquid chamber and a pressure chamber, with working liquid entering said working liquid chamber through a valve inlet and leaving said working liquid chamber through a valve outlet which is connected with said inlet of said micropump, a valve assembly at said valve inlet, opening and closing said valve inlet, and a connecting rod, connecting said membrane with said valve assembly, so that, when said membrane is deformed by pressure in said pressure chamber, said valve assembly is driven to open said valve inlet, allowing working liquid to enter said working liquid chamber and to proceed to said inlet of said micropump; and a transmission tube, transmitting outlet pressure at said outlet of said micropump to said pressure chamber of said control valve;

wherein said membrane is from opposite sides pressed on by pressure in said working liquid chamber and by pressure in said pressure chamber, controlling entering of working liquid into said inlet of said micropump, with pressure at said inlet of said micropump being kept smaller than or equal to pressure at said outlet of said micropump by a fixed difference.

2. A micropump underpressure control device according to claim 1, wherein said control valve further comprises a spring, which exerts a force driving said valve assembly to close said valve inlet.

3. A micropump underpressure control device according to claim 1, wherein said micropump is mounted at a lower side of an inlet chamber, with an upper side of said inlet chamber via said supply pipe being connected with said valve outlet.

4. A micropump underpressure control device according to claim 3, wherein said inlet chamber is set on a main body with a passageway, into which working liquid is ejected by said micropump.

5. A micropump underpressure control device according to claim 4, wherein said outlet of said micropump in said passageway is via said transmission tube connected with said pressure chamber of said control valve.

6. A micropump underpressure control device according to claim 1, wherein, when used in conjunction with a plotter or continuous-paper printer, said transmission tube connects said control valve with the outer atmosphere.

7. A micropump underpressure control device according to claim 1, wherein, when used in conjunction with a plotter or continuous-paper printer, said micropump is installed in an ejection head which is movably mounted on a rail.

* * * * *